US011795660B2

(12) United States Patent
Kondo et al.

(10) Patent No.: US 11,795,660 B2
(45) Date of Patent: Oct. 24, 2023

(54) HYDRAULIC SYSTEM OF CONSTRUCTION MACHINE

(71) Applicant: KAWASAKI JUKOGYO KABUSHIKI KAISHA, Kobe (JP)

(72) Inventors: Akihiro Kondo, Kobe (JP); Hideyasu Muraoka, Kobe (JP); Yoshiyuki Tode, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/637,676

(22) PCT Filed: Jul. 31, 2020

(86) PCT No.: PCT/JP2020/029478
§ 371 (c)(1),
(2) Date: Feb. 23, 2022

(87) PCT Pub. No.: WO2021/039283
PCT Pub. Date: Mar. 4, 2021

(65) Prior Publication Data

US 2022/0282453 A1 Sep. 8, 2022

(30) Foreign Application Priority Data

Aug. 23, 2019 (JP) ..... 2019-152658

(51) Int. Cl.
*E02F 9/12* (2006.01)
*E02F 9/22* (2006.01)
(Continued)

(52) U.S. Cl.
CPC ..... *E02F 9/2228* (2013.01); *E02F 9/123* (2013.01); *E02F 9/125* (2013.01); *E02F 9/128* (2013.01);
(Continued)

(58) Field of Classification Search
CPC ..... E02F 9/125; E02F 9/128
See application file for complete search history.

(56) References Cited

U.S. PATENT DOCUMENTS

| | | | | |
|---|---|---|---|---|
| 9,285,023 | B2 * | 3/2016 | Ishikawa | E02F 9/128 |
| 11,299,867 | B2 * | 4/2022 | Kurokawa | E02F 9/2285 |
| 2017/0166253 | A1 | 6/2017 | Kondo | |

FOREIGN PATENT DOCUMENTS

| | | | |
|---|---|---|---|
| JP | H07103207 A | * | 4/1995 |
| JP | 2017-110672 A | | 6/2017 |

OTHER PUBLICATIONS

JP H07103207 A machine translation to English from espacenet (Year: 1995).*

* cited by examiner

*Primary Examiner* — Kenneth Bomberg
*Assistant Examiner* — Michael Quandt
(74) *Attorney, Agent, or Firm* — Oliff PLC

(57) ABSTRACT

A hydraulic system of a construction machine includes: control valves interposed between a main pump and hydraulic actuators; and first solenoid proportional valves connected to pilot ports of the control valves. The hydraulic system further includes: a brake for a slewing motor; and a second solenoid proportional valve connected to a brake release port of the brake by a secondary pressure line and connected to an auxiliary pump by a primary pressure line. A switching valve including a pilot port connected to the secondary pressure line by a pilot line is interposed between the auxiliary pump and the first solenoid proportional valves.

3 Claims, 4 Drawing Sheets

(51) Int. Cl.

| | |
|---|---|
| ***E02F 9/20*** | (2006.01) |
| ***E02F 9/24*** | (2006.01) |
| ***F15B 13/044*** | (2006.01) |
| *E02F 3/32* | (2006.01) |
| *E02F 3/42* | (2006.01) |

(52) U.S. Cl.

CPC ..... *E02F 9/2004* (2013.01); *E02F 9/2267* (2013.01); *E02F 9/2271* (2013.01); *E02F 9/2285* (2013.01); *E02F 9/2292* (2013.01); *E02F 9/2296* (2013.01); *E02F 9/24* (2013.01); *F15B 13/044* (2013.01); *E02F 3/32* (2013.01); *E02F 3/425* (2013.01)

HYDRAULIC SYSTEM OF CONSTRUCTION MACHINE

This is a U.S. National Phase of International Application No. PCT/JP2020/029478 filed Jul. 31, 2020, which claims the benefit of Japanese Application No. 2019-152658 filed Aug. 23, 2019. The disclosure of the prior application is hereby incorporated by reference herein in its entirety.

TECHNICAL FIELD

The present invention relates to a hydraulic system of a construction machine.

BACKGROUND ART

In a hydraulic system installed in construction machines such as hydraulic excavators and hydraulic cranes, control valves are interposed between a main pump and hydraulic actuators. Each of the control valves controls supply and discharge of hydraulic oil to and from a corresponding one of the hydraulic actuators.

Generally speaking, each control valve includes: a spool disposed in a housing; and a pair of pilot ports for moving the spool. In a case where an operation device that outputs an electrical signal is used as an operation device to move the control valve, solenoid proportional valves are connected to the respective pilot ports of the control valve, and the control valve is driven by the solenoid proportional valves.

For example, Patent Literature 1 discloses a configuration for bringing the control valve back to its neutral position when a failure has occurred in the solenoid proportional valves for driving the control valve. In this configuration, a solenoid switching valve is interposed between an auxiliary pump and the solenoid proportional valves for driving the control valve. When a failure has occurred in the solenoid proportional valves for driving the control valve, the solenoid switching valve is switched from an open position to a closed position to stop the supply of the hydraulic oil from the auxiliary pump to the solenoid proportional valves. That is, when a failure has occurred in the solenoid proportional valves for driving the control valve, even if an operator operates the operation device, the control valve is kept in the neutral position and the operation performed on the operation device is invalidated.

CITATION LIST

Patent Literature

PTL 1: Japanese Laid-Open Patent Application Publication No. 2017-110672

SUMMARY OF INVENTION

Technical Problem

However, the configuration disclosed in Patent Literature 1 requires a solenoid valve that is dedicated for invalidating an operation performed on the operation device.

In view of the above, an object of the present invention is to provide a hydraulic system of a construction machine, the hydraulic system making it possible to invalidate operations performed on operation devices without using a solenoid valve that is dedicated for invalidating operations performed on the operation devices.

Solution to Problem

In order to solve the above-described problems, the inventors of the present invention have paid attention to the fact that, among various hydraulic systems of construction machines, some of them are configured such that the state of a hydraulic brake therein for a slewing motor is changeable by a solenoid on-off valve from a brake-applied state to a brake-released state. Then, the inventors have come up with an idea that if the solenoid on-off valve is modified into a solenoid proportional valve, it may be possible to use the solenoid proportional valve to invalidate an operation performed on an operation device. The present invention has been made from such a technological point of view. The aforementioned hydraulic brake for the slewing motor is called a parking brake, because its major role is to prevent the slewing unit from slewing when the construction machine is stationary.

Specifically, a hydraulic system of a construction machine according to one aspect of the present invention includes: hydraulic actuators including a slewing motor; a brake including a brake release port, the brake being switched from a brake-applied state, in which the brake prevents rotation of an output shaft of the slewing motor, to a brake-released state, in which the brake allows the rotation of the output shaft, when a hydraulic pressure led to the brake release port becomes higher than a first setting value; control valves interposed between a main pump and the hydraulic actuators, each control valve including pilot ports; first solenoid proportional valves connected to the pilot ports of the control valves; operation devices to move the control valves, each operation device outputting an electrical signal corresponding to an operating amount of the operation device; a controller that controls the first solenoid proportional valves based on the electrical signals outputted from the operation devices; a second solenoid proportional valve connected to the brake release port by a secondary pressure line and connected to an auxiliary pump by a primary pressure line; and a switching valve interposed between the auxiliary pump and the first solenoid proportional valves, the switching valve including a pilot port connected to the secondary pressure line by a pilot line, the switching valve switching from a closed position to an open position when a pilot pressure led to the pilot port of the switching valve becomes higher than or equal to a second setting value that is lower than the first setting value.

According to the above configuration, whether to switch the switching valve, which is interposed between the auxiliary pump and the first solenoid proportional valves, to the closed position or to the open position, i.e., whether to invalidate or validate operations performed on the operation devices, can be switched by adjusting the secondary pressure of the second solenoid proportional valve to be lower or higher than the second setting value. Also, while keeping validating operations performed on the operation devices, whether or not to apply the brake (parking brake) for the slewing motor can be switched by adjusting the secondary pressure of the second solenoid proportional valve to be lower or higher than the first setting value. This allows the second solenoid proportional valve, which is a single valve, to have two functions. Therefore, a solenoid valve dedicated for invalidating operations performed on the operation devices is unnecessary.

The construction machine may be a self-propelled hydraulic excavator. The operation devices may include a pair of travel operation devices, a slewing operation device, a boom operation device, an arm operation device, and a bucket operation device. The above hydraulic system may further include a selector that receives a selection of operation lock, which is a selection to invalidate operations performed on the operation devices, or receives a selection of operation lock release, which is a selection to validate operations performed on the operation devices. During the selector receiving the selection of operation lock, the controller may control the second solenoid proportional valve, such that a secondary pressure of the second solenoid proportional valve is lower than the second setting value. During the selector receiving the selection of operation lock release, while none of the slewing operation device, the boom operation device, the arm operation device, and the bucket operation device is being operated, the controller may control the second solenoid proportional valve, such that the secondary pressure of the second solenoid proportional valve is higher than the second setting value and lower than the first setting value, and while any of the slewing operation device, the boom operation device, the arm operation device, and the bucket operation device is being operated, the controller may control the second solenoid proportional valve, such that the secondary pressure of the second solenoid proportional valve is higher than the first setting value. According to this configuration, when the operator makes the selection of operation lock with the selector, operations performed on the operation devices are invalidated, whereas when the operator makes the selection of operation lock release with the selector, operations performed on the operation devices are validated. Also, the parking brake is switched to the brake-released state not only when a slewing operation is performed, but also when a boom operation is performed, when an arm operation is performed, and when a bucket operation is performed. For this reason, during a boom operation, an arm operation, or a bucket operation being performed, when force that causes the slewing unit to slew is exerted, for example, from the ground, the parking brake does not receive the force. Consequently, a situation where excessive force is applied to the parking brake and thereby the parking brake gets damaged is prevented. That is, the torque capacity of the parking brake can be set to a torque capacity dedicated for stationary braking. Therefore, the parking brake can be made compact. For this reason, during a boom operation, an arm operation, or a bucket operation being performed, when force that causes the slewing unit to slew is exerted, for example, from the ground, the parking brake does not receive the force. Consequently, a situation where excessive force is applied to the parking brake and thereby the parking brake gets damaged is prevented. That is, the torque capacity of the parking brake can be set to a torque capacity dedicated for stationary braking. Therefore, the parking brake can be made compact.

A hydraulic system of a construction machine according to another aspect of the present invention includes: hydraulic actuators including a slewing motor; a brake including a brake release port, the brake being switched from a brake-applied state, in which the brake prevents rotation of an output shaft of the slewing motor, to a brake-released state, in which the brake allows the rotation of the output shaft, when a hydraulic pressure led to the brake release port becomes higher than a first setting value; control valves interposed between a main pump and the hydraulic actuators, each control valve including a spool and pilot ports; first solenoid proportional valves connected to the pilot ports of the control valves; operation devices to move the control valves, each operation device outputting an electrical signal corresponding to an operating amount of the operation device; a controller that controls the first solenoid proportional valves based on the electrical signals outputted from the operation devices; a second solenoid proportional valve connected to the brake release port by a secondary pressure line and connected to an auxiliary pump by a primary pressure line; and a distribution line that connects between the secondary pressure line and the first solenoid proportional valves. The spool of each control valve moves to a stroke end when a pilot pressure led to each pilot port of the control valve becomes a second setting value, and the first setting value is higher than the second setting value.

According to the above configuration, whether to invalidate or validate operations performed on the operation devices can be switched by adjusting the secondary pressure of the second solenoid proportional valve to be zero or to be higher than the second setting value. Also, while keeping validating operations performed on the operation devices, whether or not to apply the brake (parking brake) for the slewing motor can be switched by adjusting the secondary pressure of the second solenoid proportional valve to be lower or higher than the first setting value. This allows the second solenoid proportional valve, which is a single valve, to have two functions. Therefore, a solenoid valve dedicated for invalidating operations performed on the operation devices is unnecessary.

The construction machine may be a self-propelled hydraulic excavator. The operation devices may include a pair of travel operation devices, a slewing operation device, a boom operation device, an arm operation device, and a bucket operation device. The above hydraulic system may further include a selector that receives a selection of operation lock, which is a selection to invalidate operations performed on the operation devices, or receives a selection of operation lock release, which is a selection to validate operations performed on the operation devices. During the selector receiving the selection of operation lock, the controller may control the second solenoid proportional valve, such that a secondary pressure of the second solenoid proportional valve is zero. During the selector receiving the selection of operation lock release, while none of the slewing operation device, the boom operation device, the arm operation device, and the bucket operation device is being operated, the controller may control the second solenoid proportional valve, such that the secondary pressure of the second solenoid proportional valve is higher than the second setting value and lower than the first setting value, and while any of the slewing operation device, the boom operation device, the arm operation device, and the bucket operation device is being operated, the controller may control the second solenoid proportional valve, such that the secondary pressure of the second solenoid proportional valve is higher than the first setting value. According to this configuration, when the operator makes the selection of operation lock with the selector, operations performed on the operation devices are invalidated, whereas when the operator makes the selection of operation lock release with the selector, operations performed on the operation devices are validated. Also, the parking brake is switched to the brake-released state not only when a slewing operation is performed, but also when a boom operation is performed, when an arm operation is performed, and when a bucket operation is performed. For this reason, during a boom operation, an arm operation, or a bucket operation being performed, when force that causes the slewing unit to slew is exerted, for example, from the ground, the parking brake does not receive the force. Consequently, a situation where excessive force is applied to the parking brake and thereby the parking brake gets damaged is prevented. That is, the torque capacity of the parking brake can be set to a torque capacity dedicated for stationary braking. Therefore, the parking brake can be made compact.

Advantageous Effects of Invention

The present invention makes it possible to invalidate operations performed on operation devices without using a solenoid valve that is dedicated for invalidating operations performed on the operation devices.

DESCRIPTION OF EMBODIMENTS

Embodiment 1

Figure 1:
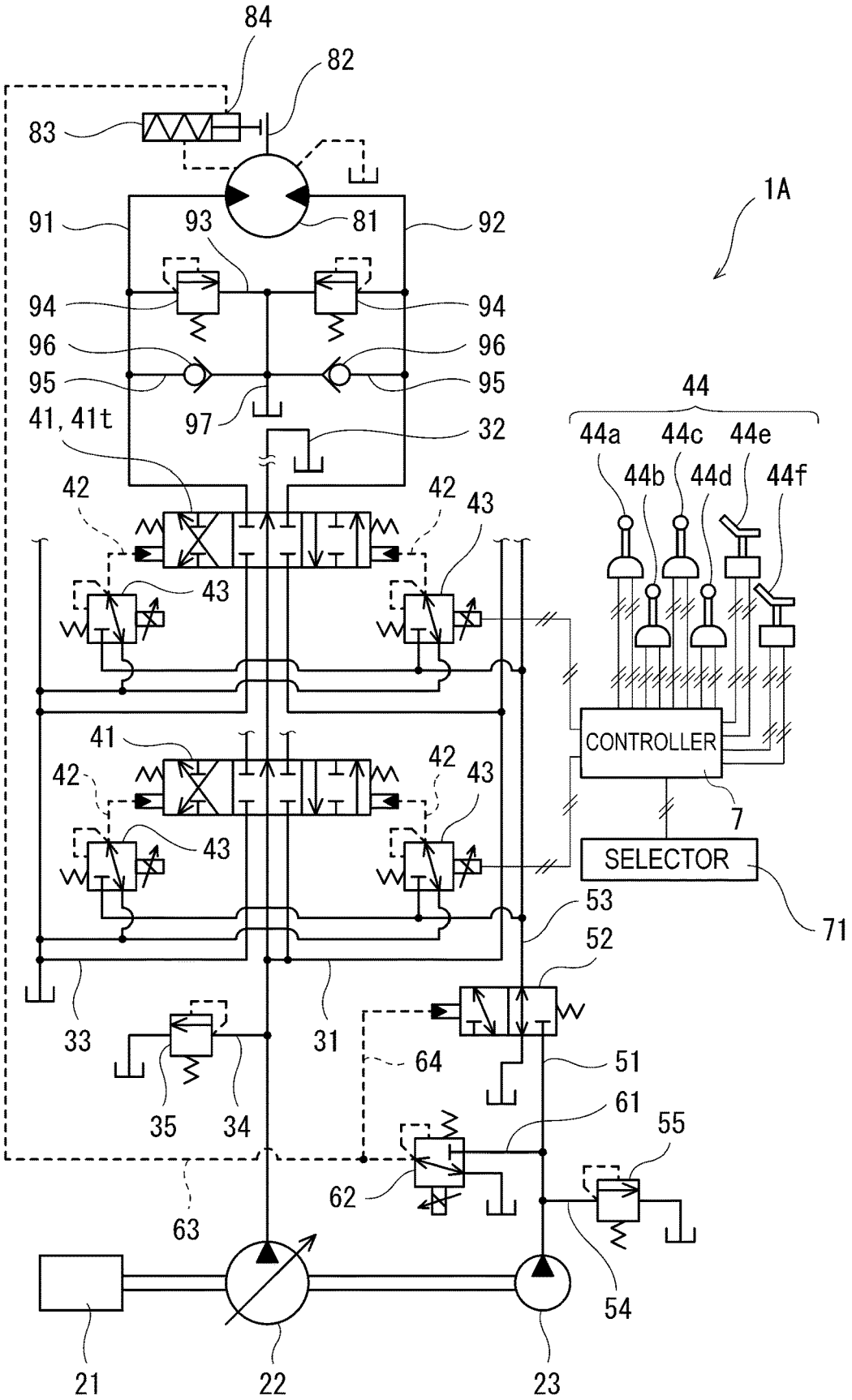
FIG. 1 shows a schematic configuration of a hydraulic system of a construction machine according to Embodiment 1 of the present invention.
Figure 2:
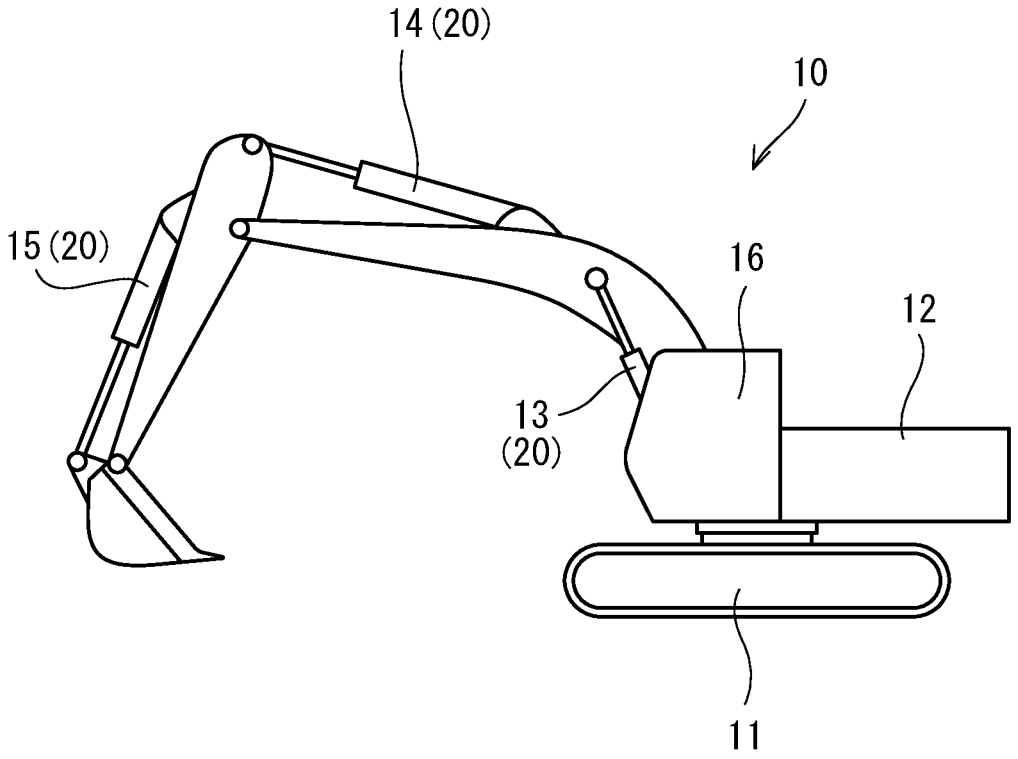
FIG. 2 is a side view of a hydraulic excavator that is one example of the construction machine.

FIG. 1 shows a hydraulic system 1A of a construction machine according to Embodiment 1 of the present invention. FIG. 2 shows a construction machine 10, in which the hydraulic system 1A is installed. Although the construction machine 10 shown in FIG. 2 is a hydraulic excavator, the present invention is applicable to other construction machines, such as a hydraulic crane.

The construction machine 10 shown in FIG. 2 is a self-propelled construction machine, and includes a traveling unit 11. The construction machine 10 further includes: a slewing unit 12 slewably supported by the traveling unit 11; and a boom that is luffed relative to the slewing unit 12. An arm is swingably coupled to the distal end of the boom, and a bucket is swingably coupled to the distal end of the arm. The slewing unit 12 is equipped with a cabin 16 including an operator's seat. The construction machine 10 need not be of a self-propelled type.

The hydraulic system 1A includes, as hydraulic actuators 20, a boom cylinder 13, an arm cylinder 14, and a bucket cylinder 15, which are shown in FIG. 2, a slewing motor 81 shown in FIG. 1, and an unshown pair of travel motors (a left travel motor and a right travel motor). The boom cylinder 13 luffs the boom. The arm cylinder 14 swings the arm. The bucket cylinder 15 swings the bucket. The slewing motor 81 slews the slewing unit 12. The left travel motor rotates a left crawler, and the right travel motor rotates a right crawler.

As shown in FIG. 1, the hydraulic system 1A further includes a main pump 22, which supplies hydraulic oil to the aforementioned hydraulic actuators 20. In FIG. 1, the illustration of the hydraulic actuators 20, except the slewing motor 81, is omitted for the purpose of simplifying the drawing.

The main pump 22 is driven by an engine 21. Alternatively, the main pump 22 may be driven by an electric motor. The engine 21 also drives an auxiliary pump 23. The number of main pumps 22 may be more than one.

The main pump 22 is a variable displacement pump (a swash plate pump or a bent axis pump) whose tilting angle is changeable. The delivery flow rate of the main pump 22 may be controlled by electrical positive control, or may be controlled by hydraulic negative control. Alternatively, the delivery flow rate of the main pump 22 may be controlled by load-sensing control.

Control valves 41 are interposed between the main pump 22 and the hydraulic actuators 20. In the present embodiment, all the control valves 41 are three-position valves. Alternatively, one or more of the control valves 41 may be two-position valves.

All the control valves 41 are connected to the main pump 22 by a supply line 31, and connected to a tank by a tank line 33. Each of the control valves 41 is connected to a corresponding one of the hydraulic actuators 20 by a pair of supply/discharge lines. In a case where the number of main pumps 22 is more than one, the same number of groups of the control valves 41 as the number of main pumps 22 are formed. In each group, the control valves 41 are connected to the corresponding main pump 22 by the supply line 31.

For example, the control valves 41 include: a boom control valve that controls supply and discharge of the hydraulic oil to and from the boom cylinder 13; an arm control valve that controls supply and discharge of the hydraulic oil to and from the arm cylinder 14; and a bucket control valve that controls supply and discharge of the hydraulic oil to and from the bucket cylinder 15. The control valves 41 also include a slewing control valve 41*t*, which controls supply and discharge of the hydraulic oil to and from the slewing motor 81.

To be more specific for the slewing control valve 41*t*, the slewing control valve 41*t* is connected to the slewing motor 81 by a pair of supply/discharge lines 91 and 92. The supply/discharge lines 91 and 92 are connected to each other by a bridging passage 93. The bridging passage 93 is provided with a pair of relief valves 94, which are directed opposite to each other. A portion of the bridging passage 93 between the relief valves 94 is connected to the tank by a make-up line 97. Each of the supply/discharge lines 91 and 92 is connected to the make-up line 97 by a corresponding one of bypass lines 95. Alternatively, the pair of bypass lines 95 may be provided on the bridging passage 93 in a manner to bypass the pair of relief valves 94, respectively. The bypass lines 95 are provided with check valves 96, respectively.

The slewing motor 81 is provided with a hydraulic brake 83. The brake 83 includes a brake release port 84. When a hydraulic pressure led to the brake release port 84 becomes higher than a first setting value $\alpha$, the brake 83 is switched from a brake-applied state, in which the brake 83 prevents the rotation of an output shaft 82 of the slewing motor 81, to a brake-released state, in which the brake 83 allows the rotation of the output shaft 82.

The aforementioned supply line 31 includes a main passage and branch passages. The main passage extends from the main pump 22. The branch passages are branched off from the main passage, and connect to the control valves 41. In the present embodiment, a center bypass line 32 is branched off from the main passage of the supply line 31, and the center bypass line 32 extends to the tank. The control valves 41 are disposed on the center bypass line 32. The center bypass line 32 may be eliminated.

A relief line 34 is branched off from the main passage of the supply line 31, and the relief line 34 is provided with a relief valve 35 for the main pump 22. The relief line 34 may be branched off from the center bypass line 32 at a position upstream of all the control valves 41.

Each control valve 41 includes: a spool disposed in a housing; and a pair of pilot ports for moving the spool. For example, the housings of all the control valves 41 may be integrated together to form a multi-control valve unit. The pilot ports of each control valve 41 are connected to respective first solenoid proportional valves 43 by respective pilot lines 42.

Each first solenoid proportional valve 43 is a direct proportional valve that outputs a secondary pressure indicating a positive correlation with a command current. Alternatively, each first solenoid proportional valve 43 may be an inverse proportional valve that outputs a secondary pressure indicating a negative correlation with the command current.

All the first solenoid proportional valves 43 are connected to a switching valve 52 by a distribution line 53. The distribution line 53 includes a main passage and branch passages. The main passage extends from the switching valve 52. The branch passages are branched off from the main passage, and connect to the first solenoid proportional valves 43.

The switching valve 52 is connected to the auxiliary pump 23 by a pump line 51. A relief line 54 is branched off from the pump line 51, and the relief line 54 is provided with a relief valve 55 for the auxiliary pump 23. The relief pressure of the relief valve 55 is set sufficiently high (e.g., 4 MPa) so that the spool of each control valve 41 can move to the stroke end. The relief pressure of the relief valve 55 is higher, to some extent, than the first setting value $\alpha$ of the brake 83.

The switching valve 52 interposed between the auxiliary pump 23 and all the first solenoid proportional valves 43 includes a pilot port, and when a pilot pressure led to the pilot port becomes higher than or equal to a second setting value (3, the switching valve 52 switches from a closed position, which is a neutral position, to an open position. When the switching valve 52 is in the closed position, the switching valve 52 blocks the pump line 51, and brings the distribution line 53 into communication with the tank. When the switching valve 52 is in the open position, the switching valve 52 brings the pump line 51 into communication with the distribution line 53. In other words, in a state where the switching valve 52 is kept in the closed position, the supply of the hydraulic oil from the auxiliary pump 23 to the first solenoid proportional valves 43 is stopped, and the primary pressure of each first solenoid proportional valve 43 is zero. Accordingly, even when electric currents are fed to the first solenoid proportional valves 43, the control valves 41 do not move. That is, each control valve 41 stays in its neutral position.

The second setting value $\beta$ of the switching valve 52 is set lower than the first setting value $\alpha$ of the brake 83. For example, the first setting value $\alpha$ is 3.5 MPa, and the second setting value $\beta$ is 0.5 MPa.

The auxiliary pump 23 is connected also to a second solenoid proportional valve 62 by a primary pressure line 61, and the second solenoid proportional valve 62 is connected to the brake release port 84 of the brake 83 by a secondary pressure line 63. The upstream portion of the primary pressure line 61 and the upstream portion of the pump line 51 merge together to form a shared passage.

The second solenoid proportional valve 62 is a direct proportional valve that outputs a secondary pressure indicating a positive correlation with a command current. Alternatively, the second solenoid proportional valve 62 may be an inverse proportional valve that outputs a secondary pressure indicating a negative correlation with the command current. The pilot port of the switching valve 52 is connected to the secondary pressure line 63 by a pilot line 64.

Operation devices 44 to move the control valves 41 are disposed in the aforementioned cabin 16. Each operation device 44 includes an operating unit (an operating lever or a foot pedal) that receives an operation for moving a corresponding one of the hydraulic actuators 20, and outputs an electrical signal corresponding to an operating amount of the operating unit (e.g., an inclination angle of the operating lever).

Specifically, the operation devices 44 include: a boom operation device 44*a*, an arm operation device 44*b*, a bucket operation device 44*c*, and a slewing operation device 44*d*, each of which includes an operating lever; and a left travel operation device 44*e* and a right travel operation device 44*f*, each of which includes a foot pedal. Some of the operation devices 44 may be combined together and may share the same operating lever. For example, the boom operation device 44*a* and the bucket operation device 44*c* may be combined together, and the arm operation device 44*b* and the slewing operation device 44*d* may be combined together.

The operating lever of the boom operation device 44*a* receives a boom raising operation and a boom lowering operation. The operating lever of the arm operation device 44*b* receives an arm crowding operation and an arm pushing operation. The operating lever of the bucket operation device 44*c* receives a bucket excavating operation and a bucket dumping operation. The operating lever of the slewing operation device 44*d* receives a left slewing operation and a right slewing operation. Each of the foot pedal of the left travel operation device 44*e* and the foot pedal of the right travel operation device 44*f* receives a forward travel operation and a backward travel operation. For example, when the operating lever of the slewing operation device 44*d* is inclined in a left slewing direction, the slewing operation device 44*d* outputs a left slewing electrical signal whose magnitude corresponds to the inclination angle of the operating lever.

The electrical signal outputted from each operation device 44 is inputted to a controller 7. For example, the controller 7 is a computer including memories such as a ROM and RAM, a storage such as a HDD, and a CPU. The CPU executes a program stored in the ROM or HDD.

The controller 7 controls the first solenoid proportional valves 43 based on the electrical signals outputted from the operation devices 44. FIG. 1 shows only part of signal lines for simplifying the drawing. For example, when a left slewing electrical signal is outputted from the slewing operation device 44*d*, the controller 7 feeds a command current to the first solenoid proportional valve 43 connected to a left slewing pilot port of the slewing control valve 41*t*, and increases the command current in accordance with increase in the left slewing electrical signal.

A selector 71 is disposed in the cabin 16. With the selector 71, an operator selects whether to invalidate or validate operations performed on all the operation devices 44. The selector 71 receives a selection of operation lock, which is a selection to invalidate operations performed on the operation devices 44, or receives a selection of operation lock release, which is a selection to validate operations performed on the operation devices 44.

For example, the selector 71 may be a micro switch or limit switch including a safety lever, and by shifting or swinging the safety lever, the selection of operation lock or the selection of operation lock release can be made. Alternatively, the selector 71 may be a push button switch including a button, and by pushing or not pushing the button, the selection of operation lock or the selection of operation lock release can be made.

The controller 7 controls the second solenoid proportional valve 62 in accordance with a selection status of the selector 71 in the following manner.

Figure 3:
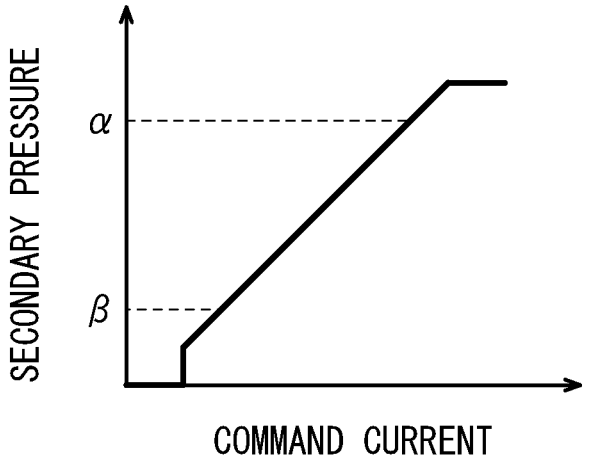
FIG. 3 is a graph showing a relationship between a command current to a second solenoid proportional valve and a secondary pressure of the second solenoid proportional valve in Embodiment 1.

During the selector 71 receiving the selection of operation lock, the controller 7 controls the second solenoid proportional valve 62, such that the secondary pressure of the second solenoid proportional valve 62 is lower than the second setting value β as shown in FIG. 3. As a result, the brake 83 is kept in the brake-applied state, and the switching valve 52 is kept in the closed position. At the time, the controller 7 may feed no command current to the second solenoid proportional valve 62, or may feed a command current lower than the electric current value corresponding to the second setting value β to the second solenoid proportional valve 62.

On the other hand, during the selector 71 receiving the selection of operation lock release, the control of the second solenoid proportional valve 62 differs depending on the operation status of the slewing operation device 44*d*, the boom operation device 44*a*, the arm operation device 44*b*, and the bucket operation device 44*c*. Hereinafter, the boom operation device 44*a*, the arm operation device 44*b*, and the bucket operation device 44*c* are collectively referred to as front operation devices. Based on the electrical signal outputted from each operation device 44, the controller 7 determines whether the operation device 44 is being operated or not.

While none of the slewing operation device 44*d* and the front operation devices is being operated, the controller 7 controls the second solenoid proportional valve 62, such that the secondary pressure of the second solenoid proportional valve 62 is higher than the second setting value β and lower than the first setting value α. As a result, the brake 83 is kept in the brake-applied state, and the switching valve 52 is switched to the open position. At the time, the value of the command current that the controller 7 feeds to the second solenoid proportional valve 62 may be any value, so long as it is higher than the electric current value corresponding to the second setting value β and lower than the electric current value corresponding to the first setting value α.

On the other hand, while any of the slewing operation device 44*d* and the front operation devices is being operated, the controller 7 controls the second solenoid proportional valve 62, such that the secondary pressure of the second solenoid proportional valve 62 is higher than the first setting value α. As a result, with the switching valve 52 kept in the open position, the brake 83 is switched to the brake-released state. For example, the controller 7 maximizes the command current to feed to the second solenoid proportional valve 62. As a result, the secondary pressure of the second solenoid proportional valve 62 is equalized to the primary pressure (the relief pressure of the relief valve 55).

As described above, in the hydraulic system 1A of the present embodiment, whether to switch the switching valve 52, which is interposed between the auxiliary pump 23 and the first solenoid proportional valves 43, to the closed position or to the open position, i.e., whether to invalidate or validate operations performed on the operation devices 44, can be switched by adjusting the secondary pressure of the second solenoid proportional valve 62 to be lower or higher than the second setting value β. Also, while keeping validating operations performed on the operation devices 44, whether or not to apply the brake (parking brake) 83 for the slewing motor 81 can be switched by adjusting the secondary pressure of the second solenoid proportional valve 62 to be lower or higher than the first setting value α. This allows the second solenoid proportional valve 62, which is a single valve, to have two functions. Therefore, a solenoid valve dedicated for invalidating operations performed on the operation devices 44 is unnecessary.

Also, in the present embodiment, the parking brake 83 is switched to the brake-released state not only when a slewing operation is performed, but also when a boom operation is performed, when an arm operation is performed, and when a bucket operation is performed. For this reason, during a boom operation, an arm operation, or a bucket operation being performed, when force that causes the slewing unit to slew is exerted, for example, from the ground, the parking brake 83 does not receive the force. Consequently, a situation where excessive force is applied to the parking brake 83 and thereby the parking brake 83 gets damaged is prevented. That is, the torque capacity of the parking brake 83 can be set to a torque capacity dedicated for stationary braking. Therefore, the parking brake 83 can be made compact.

Since the present embodiment includes the selector 71, when the operator makes the selection of operation lock with the selector 71, operations performed on the operation devices 44 are invalidated, whereas when the operator makes the selection of operation lock release with the selector 71, operations performed on the operation devices 44 are validated.

Embodiment 2

Figure 4:
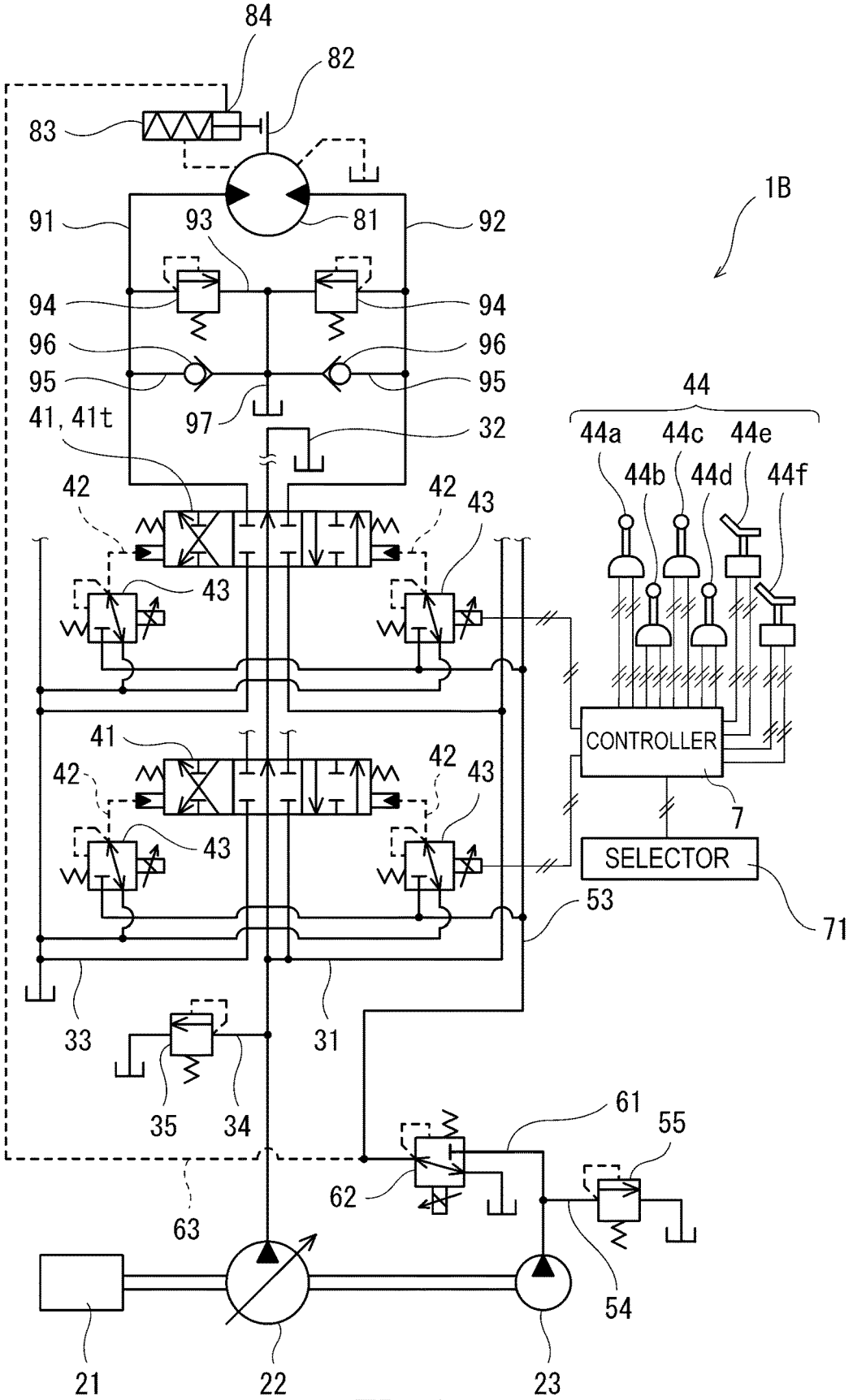
FIG. 4 shows a schematic configuration of a hydraulic system of a construction machine according to Embodiment 2 of the present invention.

FIG. 4 shows a hydraulic system 1B according to Embodiment 2 of the present invention. In the present embodiment, the same components as those described in Embodiment 1 are denoted by the same reference signs as those used in Embodiment 1, and repeating the same descriptions is avoided.

In the present embodiment, the switching valve 52 shown in FIG. 1 is eliminated, and also, the upstream end of the distribution line 53 is connected to the secondary pressure line 63. That is, the distribution line 53 connects between the secondary pressure line 63 and all the first solenoid proportional valves 43.

Further, in the present embodiment, the spool of each control valve 41 moves to the stroke end when a pilot pressure led to each pilot port of the control valve 41 becomes a second setting value γ. The first setting value α of the brake 83 is higher than the second setting value γ. For example, the second setting value γ is 2.0 to 3.0 MPa, and the first setting value α is 3.1 to 3.8 MPa.

Figure 5:
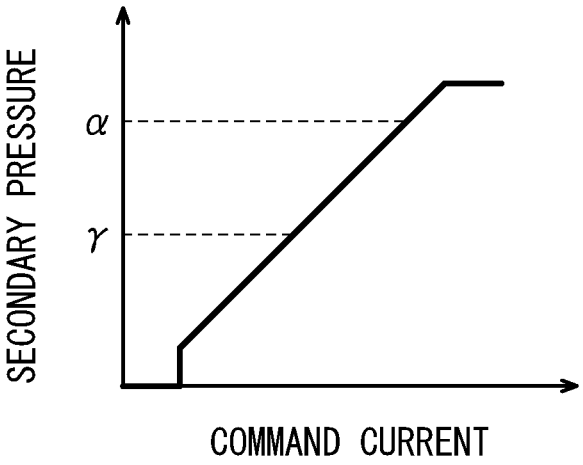
FIG. 5 is a graph showing a relationship between the command current to the second solenoid proportional valve and the secondary pressure of the second solenoid proportional valve in Embodiment 2.

Next, the control of the second solenoid proportional valve 62 by the controller 7 is described with reference to FIG. 5.

During the selector 71 receiving the selection of operation lock, the controller 7 controls the second solenoid proportional valve 62, such that the secondary pressure of the second solenoid proportional valve 62 is zero. That is, the controller 7 feeds no command current to the second solenoid proportional valve 62. As a result, the brake 83 is kept locked, and the primary pressure of each first solenoid proportional valve 43 is zero (even when electric currents are fed to the first solenoid proportional valves 43, the control valves 41 do not move).

On the other hand, during the selector 71 receiving the selection of operation lock release, the control of the second solenoid proportional valve 62 differs depending on the operation status of the slewing operation device 44*d* and the front operation devices. Based on the electrical signal outputted from each operation device 44, the controller 7 determines whether the operation device 44 is being operated or not.

While none of the slewing operation device 44*d* and the front operation devices is being operated, the controller 7 controls the second solenoid proportional valve 62, such that the secondary pressure of the second solenoid proportional valve 62 is higher than the second setting value γ and lower than the first setting value α. As a result, the brake 83 is kept in the brake-applied state, and the primary pressure of each first solenoid proportional valve 43 is higher than the second setting value γ (the spool of each control valve 41 can move to the stroke end). At the time, the value of the command current that the controller 7 feeds to the second solenoid proportional valve 62 may be any value, so long as it is higher than the electric current value corresponding to the second setting value γ and lower than the electric current value corresponding to the first setting value α.

On the other hand, while any of the slewing operation device 44*d* and the front operation devices is being operated, the controller 7 controls the second solenoid proportional valve 62, such that the secondary pressure of the second solenoid proportional valve 62 is higher than the first setting value α. As a result, with the primary pressure of each first solenoid proportional valve 43 kept higher than the second setting value γ, the brake 83 is switched to the brake-released state. For example, the controller 7 maximizes the command current to feed to the second solenoid proportional valve 62. As a result, the secondary pressure of the second solenoid proportional valve 62 is equalized to the primary pressure (the relief pressure of the relief valve 55).

As described above, in the hydraulic system 1B of the present embodiment, whether to invalidate or validate operations performed on the operation devices 44 can be switched by adjusting the secondary pressure of the second solenoid proportional valve 62 to be zero or to be higher than the second setting value γ. Also, while keeping validating operations performed on the operation devices 44, whether or not to apply the brake (parking brake) 83 for the slewing motor 81 can be switched by adjusting the secondary pressure of the second solenoid proportional valve 62 to be lower or higher than the first setting value α. This allows the second solenoid proportional valve 62, which is a single valve, to have two functions. Therefore, a solenoid valve dedicated for invalidating operations performed on the operation devices 44 is unnecessary.

Also in the present embodiment, similar to Embodiment 1, the parking brake 83 is switched to the brake-released state not only when a slewing operation is performed, but also when a boom operation is performed, when an arm operation is performed, and when a bucket operation is performed. Therefore, a situation where excessive force is applied to the parking brake 83 and thereby the parking brake 83 gets damaged is prevented.

OTHER EMBODIMENTS

The present invention is not limited to the above-described embodiments. Various modifications can be made without departing from the scope of the present invention.

The invention claimed is:

1. A hydraulic system of a construction machine, comprising:

hydraulic actuators including a slewing motor;

a brake including a brake release port, the brake being switched from a brake-applied state, in which the brake prevents rotation of an output shaft of the slewing motor, to a brake-released state, in which the brake allows the rotation of the output shaft, when a hydraulic pressure led to the brake release port becomes higher than a first setting value;

control valves interposed between a main pump and the hydraulic actuators, each control valve including pilot ports;

first solenoid proportional valves connected to the pilot ports of the control valves;

operation devices to move the control valves, each operation device outputting an electrical signal corresponding to an operating amount of the operation device;

a controller that controls the first solenoid proportional valves based on the electrical signals outputted from the operation devices;

a second solenoid proportional valve connected to the brake release port by a secondary pressure line and connected to an auxiliary pump by a primary pressure line; and a switching valve interposed between the auxiliary pump and the first solenoid proportional valves, the switching valve including a pilot port connected to the secondary pressure line by a pilot line, the switching valve switching from a closed position to an open position when a pilot pressure led to the pilot port of the switching valve becomes higher than or equal to a second setting value that is lower than the first setting value.

2. The hydraulic system of a construction machine according to claim 1, wherein the construction machine is a self-propelled hydraulic excavator, the operation devices include a pair of travel operation devices, a slewing operation device, a boom operation device, an arm operation device, and a bucket operation device, the hydraulic system further comprises a selector that receives a selection of operation lock, which is a selection to invalidate operations performed on the operation devices, or receives a selection of operation lock release, which is a selection to validate operations performed on the operation devices, during the selector receiving the selection of operation lock, the controller controls the second solenoid proportional valve, such that a secondary pressure of the second solenoid proportional valve is lower than the second setting value, and during the selector receiving the selection of operation lock release, while none of the slewing operation device, the boom operation device, the arm operation device, and the bucket operation device is being operated, the controller controls the second solenoid proportional valve, such that the secondary pressure of the second solenoid proportional valve is higher than the second setting value and lower than the first setting value, and while any of the slewing operation device, the boom operation device, the arm operation device, and the bucket operation device is being operated, the controller controls the second solenoid proportional valve, such that the secondary pressure of the second solenoid proportional valve is higher than the first setting value.

3. A hydraulic system of a construction machine, comprising:

hydraulic actuators including a slewing motor;

a brake including a brake release port, the brake being switched from a brake-applied state, in which the brake prevents rotation of an output shaft of the slewing motor, to a brake-released state, in which the brake allows the rotation of the output shaft, when a hydraulic pressure led to the brake release port becomes higher than a first setting value;

control valves interposed between a main pump and the hydraulic actuators, each control valve including a spool and pilot ports;

first solenoid proportional valves connected to the pilot ports of the control valves;

operation devices to move the control valves, each operation device outputting an electrical signal corresponding to an operating amount of the operation device;

a controller that controls the first solenoid proportional valves based on the electrical signals outputted from the operation devices;

a second solenoid proportional valve connected to the brake release port by a secondary pressure line and connected to an auxiliary pump by a primary pressure line; and a distribution line that connects between the secondary pressure line and the first solenoid proportional valves, wherein the spool of each control valve moves to a stroke end when a pilot pressure led to each pilot port of the control valve becomes a second setting value, the first setting value is higher than the second setting value, the construction machine is a self-propelled hydraulic excavator, the operation devices include a pair of travel operation devices, a slewing operation device, a boom operation device, an arm operation device, and a bucket operation device, the hydraulic system further comprises a selector that receives a selection of operation lock, which is a selection to invalidate operations performed on the operation devices, or receives a selection of operation lock release, which is a selection to validate operations performed on the operation devices, during the selector receiving the selection of operation lock, the controller controls the second solenoid proportional valve, such that a secondary pressure of the second solenoid proportional valve is zero, and during the selector receiving the selection of operation lock release, while none of the slewing operation device, the boom operation device, the arm operation device, and the bucket operation device is being operated, the controller controls the second solenoid proportional valve, such that the secondary pressure of the second solenoid proportional valve is higher than the second setting value and lower than the first setting value, and while any of the slewing operation device, the boom operation device, the arm operation device, and the bucket operation device is being operated, the controller controls the second solenoid proportional valve, such that the secondary pressure of the second solenoid proportional valve is higher than the first setting value.

* * * * *